US011674468B2

(12) United States Patent
Miura

(10) Patent No.: US 11,674,468 B2
(45) Date of Patent: Jun. 13, 2023

(54) EVAPORATIVE FUEL PROCESSING DEVICE

(71) Applicant: DENSO CORPORATION, Kariya (JP)

(72) Inventor: Yuichiro Miura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/466,962

(22) Filed: Sep. 3, 2021

(65) Prior Publication Data

US 2022/0074364 A1 Mar. 10, 2022

(30) Foreign Application Priority Data

Sep. 7, 2020 (JP) ..... JP2020-149722

(51) Int. Cl.
*F02D 41/22* (2006.01)
*F02M 25/08* (2006.01)
*F02M 35/10* (2006.01)

(52) U.S. Cl.
CPC ..... *F02D 41/22* (2013.01); *F02M 25/0818* (2013.01); *F02M 25/0836* (2013.01); *F02M 25/0872* (2013.01); *F02M 35/10222* (2013.01); *F02D 2041/225* (2013.01)

(58) Field of Classification Search
CPC ..... F02D 41/22; F02D 2041/225; F02M 25/0818; F02M 25/0836; F02M 25/0872; F02M 35/10222
See application file for complete search history.

(56) References Cited

U.S. PATENT DOCUMENTS 6,321,728 B1 * 11/2001 Ohkuma ..... F02M 25/0809 123/520
6,698,280 B1 * 3/2004 Iden ..... F02M 25/0818 73/114.38
2003/0131655 A1 * 7/2003 Miyahara ..... F02M 25/0818 73/37
2003/0192370 A1 * 10/2003 Amano ..... F02M 25/0809 73/114.39
2003/0226549 A1 * 12/2003 Takagi ..... F02M 25/0818 73/114.38
2004/0089064 A1 * 5/2004 Kidokoro ..... F02M 25/0809 73/114.39

(Continued)

*Primary Examiner* — Hung Q Nguyen
*Assistant Examiner* — Susan E Scharpf
(74) *Attorney, Agent, or Firm* — Nixon & Vanderhye P.C.

(57) ABSTRACT

An evaporative fuel processing device for determining a leak of an evaporation piping system also determined pump abnormality by including a pump, a pressure sensor and an abnormality determiner, i.e., by pressuring/de-pressuring the system to a positive/negative value against an atmospheric pressure for leak determination, by detecting a pressure of the system, and by determining a leak hole in a normal leak determination mode based on an absolute value of the detected pressure reaching or not reaching a target value after pump operation and based on an assumption that the pump is normal. Specifically, after lapse of a determination time from a pump stop, the absolute value equal to or less than a normal leak determination threshold value is determined that a leak hole is present in the system. Further, the absolute value not reaching the target value even after pump operation triggers a pump abnormality determination mode.

12 Claims, 6 Drawing Sheets

(56) References Cited

U.S. PATENT DOCUMENTS

| | | | | |
|---|---|---|---|---|
| 2004/0200460 | A1* | 10/2004 | Mitani | F02M 25/0818 73/40 |
| 2004/0250604 | A1* | 12/2004 | Watanabe | F02M 25/0809 73/49.2 |
| 2005/0089407 | A1* | 4/2005 | Hosoya | F02M 25/0818 417/63 |
| 2015/0013437 | A1* | 1/2015 | Takakura | F02M 25/0818 73/40.5 R |

* cited by examiner

1ST EMBODIMENT

2ND EMBODIMENT

COMPARATIVE EXAMPLE

EVAPORATIVE FUEL PROCESSING DEVICE

CROSS REFERENCE TO RELATED APPLICATION

The present application is based on and claims the benefit of priority of Japanese Patent Application No. 2020-149722, filed on Sep. 7, 2020, the disclosure of which is incorporated herein by reference.

TECHNICAL FIELD

The present disclosure generally relates to an evaporative fuel processing device.

BACKGROUND

Conventionally, in an evaporative fuel processing device that collects evaporated fuel in a fuel tank and supplies it to an intake passage, a device that determines leakage of an evaporation piping system is known/has been used.

For example, a conventional evaporative fuel processing device includes a pump connected to a region on a canister side of a block valve to pressurize the inside of the system including a canister and a fuel tank, and a pressure sensor for detecting the pressure in the system. A diagnostic device operates the pump with the block valve closed to pressurize the inside of the system, then opens the block valve and sends air into the fuel tank to make a tank internal pressure higher than the surrounding atmospheric pressure, i.e., to bring it to a certain diagnostic pressure higher than the atmospheric pressure. After that, the diagnostic device closes the block valve, and examines the time change of the tank internal pressure to determine leakage.

SUMMARY

The present disclosure concerns an evaporative fuel processing device that determines leakage in an evaporation piping system.

In one embodiment, the evaporation piping system includes: a fuel tank connected to a canister absorbing evaporated fuel via a vapor passage, an atmospheric on-off valve provided in an atmospheric passage that connects the canister and an air opening, and a purge valve provided in a purge passage that connects the canister and an intake passage.

The evaporative fuel processing device includes a pump, a pressure sensor, and an abnormality determiner. The pump operates so as to pressurize or depressurize an internal pressure or an in-system pressure, which is the internal pressure of the evaporation piping system, bringing it to a positive pressure or a negative pressure with respect to the atmospheric pressure for the determination of the leakage. The pressure sensor detects a pressure inside the system (i.e., detects the in-system pressure). The abnormality determiner determines the presence or absence of a leak hole in the evaporation piping system and the abnormality of the pump based on the pressure inside the system detected by the pressure sensor.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereinafter, a plurality of embodiments of an evaporated fuel processing device according to the present disclosure are described with reference to the drawings. The evaporative fuel processing device collects the fuel evaporated from the fuel tank in the vehicle by the canister, and supplies it to an intake passage. In particular, the evaporated fuel processing device of the present embodiment determines the leak of an evaporation piping system and an abnormality of a pump used for the leak determination.

[Overall Configuration of Evaporation Piping System]

Figure 1:
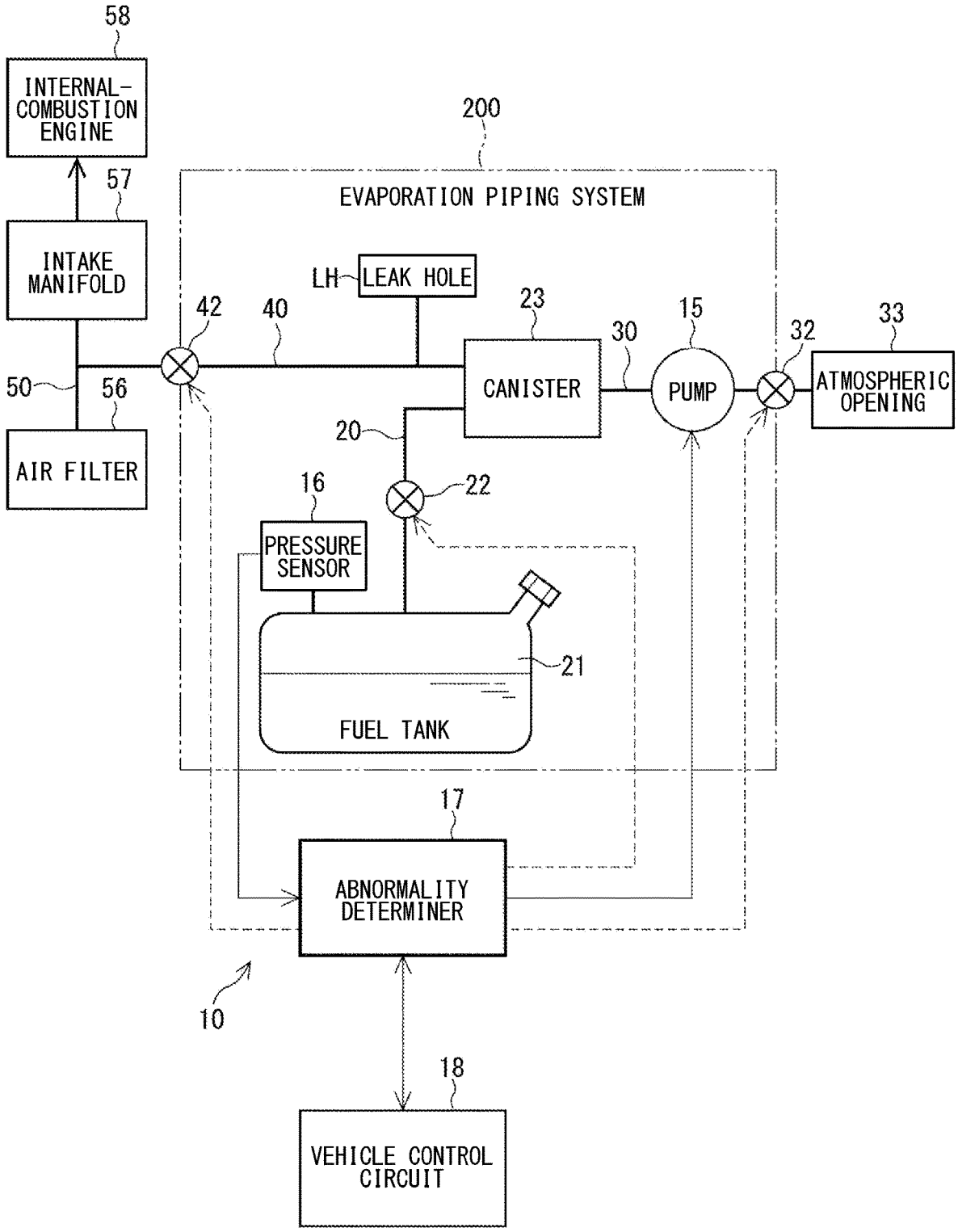
FIG. 1 is an overall configuration diagram of an evaporation piping system subject to leak determination by an evaporative fuel processing device.

First, with reference to FIG. 1, the overall configuration of an evaporation piping system 200, which is a subject of a leak determination by the evaporative fuel processing device is described. The evaporation piping system 200 includes a fuel tank 21, a vapor passage 20, a canister 23, an atmospheric passage 30, a purge passage 40, and the like. The fuel tank 21 in which the fuel is stored is connected to the canister 23 that absorbs the evaporated fuel via the vapor passage 20.

The atmospheric passage 30 is a passage connecting the canister 23 and the atmospheric opening 33, and an atmospheric on-off valve 32 is provided in the middle of the atmospheric passage 30. The purge passage 40 is a passage connecting the canister 23 and an intake passage 50, and a purge valve 42 is provided in the middle of the purge passage 40. The intake passage 50 to which the purge passage 40 is connected reaches an internal-combustion engine 58 extending from an air filter 56 via an intake manifold 57.

With the atmospheric on-off valve 32 and the purge valve 42 open, the evaporated fuel absorbed on the canister 23 is purged to the intake passage 50 via the purge passage 40 together with the air introduced through the atmospheric passage 30. At such timing, an amount of evaporated fuel purged from the canister 23 to the intake passage 50 is adjusted according to an opening degree of the purge valve 42.

Further, in a configuration example shown in FIG. 1, a block valve 22 is provided in the vapor passage 20. As a general rule, the block valve 22 shuts off the fuel tank 21 and the canister 23 except when refueling, so that the fuel tank 21 is sealed. However, the block valve 22 may be dispensed. When the block valve 22 is dispensed, it is equivalent to a state in which the block valve 22 of FIG. 1 is always open.

In such manner, a region partitioned by the fuel tank 21, the atmospheric on-off valve 32, and the purge valve 42 is provided as the evaporation piping system 200 through which the atmosphere mixed with the evaporated fuel flows. Assuming that a tank cap of the fuel tank 21 is closed, the evaporation piping system 200 is closed from the atmosphere in a state in which the atmospheric on-off valve 32 and the purge valve 42 are closed and the block valve 22 is opened. Further, in a state in which the atmospheric on-off valve 32, the purge valve 42, and the block valve 22 are all closed, the evaporation piping system 200 on the canister 23 side of the block valve 22 is closed. Hereinafter, an internal pressure of the evaporation piping system 200 may be referred to as a "system internal pressure (i.e., the in-system pressure)".

For example, FIG. 1 shows a case where a pipe of the purge passage 40 has a leak hole LH. An evaporative fuel processing device 10 of the present embodiment has a pump 15, a pressure sensor 16, and an abnormality determiner 17 as a configuration for determining leak of the evaporated fuel from a leak hole generated in a component or piping of the evaporation piping system 200. In addition, whether or not respective elements of the evaporation piping system 200 such as the canister 23, the atmospheric on-off valve 32, and the purge valve 42 are included as a component of the "evaporative fuel processing device" may be situation dependent.

In the configuration example of FIG. 1, the pump 15 is provided on a canister 23 side of the atmospheric on-off valve 32 in the atmospheric passage 30. The pump 15 operates so as to pressurize the internal pressure (i.e., to increase the in-system pressure) to a certain positive pressure value or to a certain negative pressure with respect to the atmospheric pressure at the time of determining the leakage. Assuming that the atmospheric pressure is a reference value, that is, 0, in case of using a pressurizing pump, the system internal pressure (i.e., the in-system pressure) increases from 0 toward a positive value by the operation of the pump 15, and in case of using a decompression pump, the system internal pressure (i.e., the in-system pressure) decreases from 0 by the operation of the pump 15. In the description of the change in the system pressure, an "absolute value of the system pressure" when the atmospheric pressure is assumed as 0 (zero) is described as a parameter in order to collectively describe actions and situations of the pressurizing pump and the decompression pump.

The pressure sensor 16 detects the pressure inside the system. The pressure sensor 16 of the configuration example of FIG. 1 is provided so as to detect a gas pressure in an upper space of the fuel tank 21. In the configuration example of FIG. 1, the pressure inside the system is detected with the block valve 22 open.

The abnormality determiner 17 determines whether or not there is a leak hole in the evaporation piping system 200 and an abnormality in the pump 15 based on the pressure inside the system detected by the pressure sensor 16. The "abnormality of the pump 15" is assumed to be an event in which the original pressurizing/depressurizing function is not exhibited mainly due to wear, deterioration, electrical contact failure, or the like of mechanical parts.

Specifically, the abnormality determiner 17 is composed of an ECU or the like. As shown by the broken line in FIG. 1, the abnormality determiner 17 may perform the opening/closing control of the block valve 22, the atmospheric on-off valve 32, the purge valve 42, and the like, or other control circuit that communicates with the abnormality determiner 17 may perform such a control. Further, the abnormality determiner 17 communicates with a higher-level vehicle control circuit 18, and notifies abnormality information or the like as necessary.

[Leak Determination and Pump Abnormality Determination]

Next, the details of the leak and the pump abnormality determination by the abnormality determiner 17 is described for each of the embodiments. The device configurations themselves of the first embodiment and the second embodiment are the same, and some of the steps in the flowcharts of the abnormality determination are different.

First Embodiment

Figure 2A:
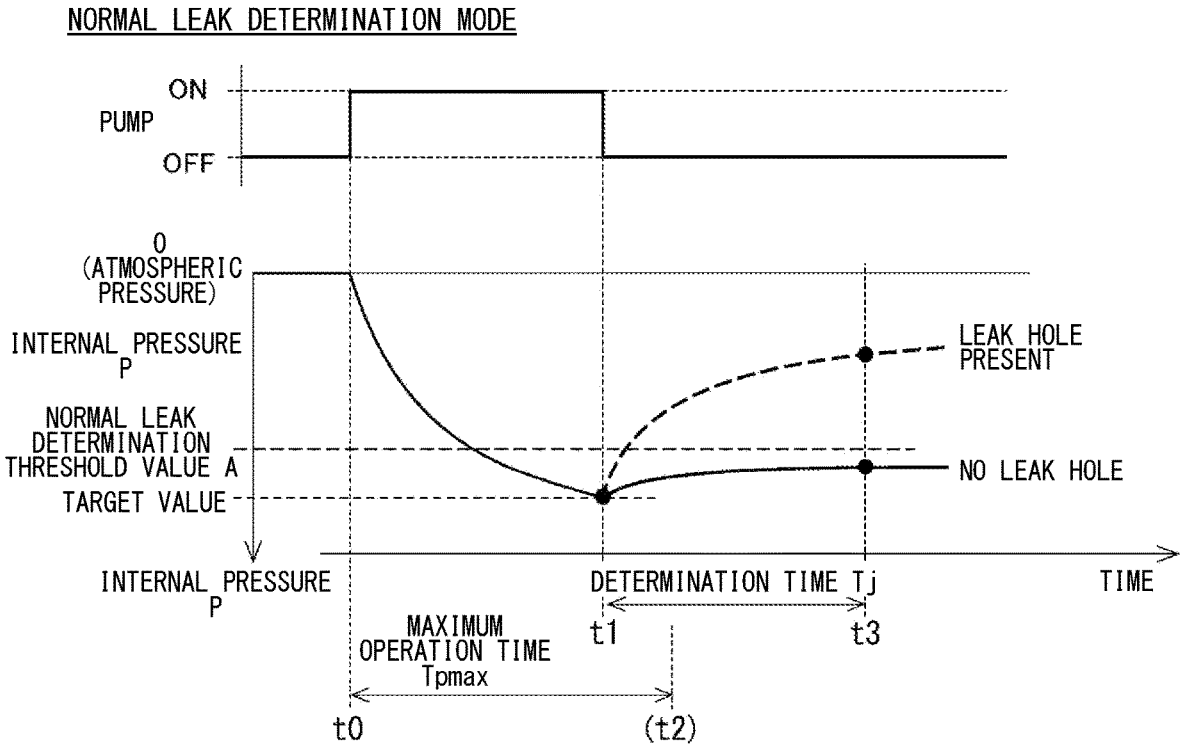
FIG. 2A is a time chart of normal leak determination and FIG. 2B is pump abnormality determination according to a first embodiment.
Figure 2B:
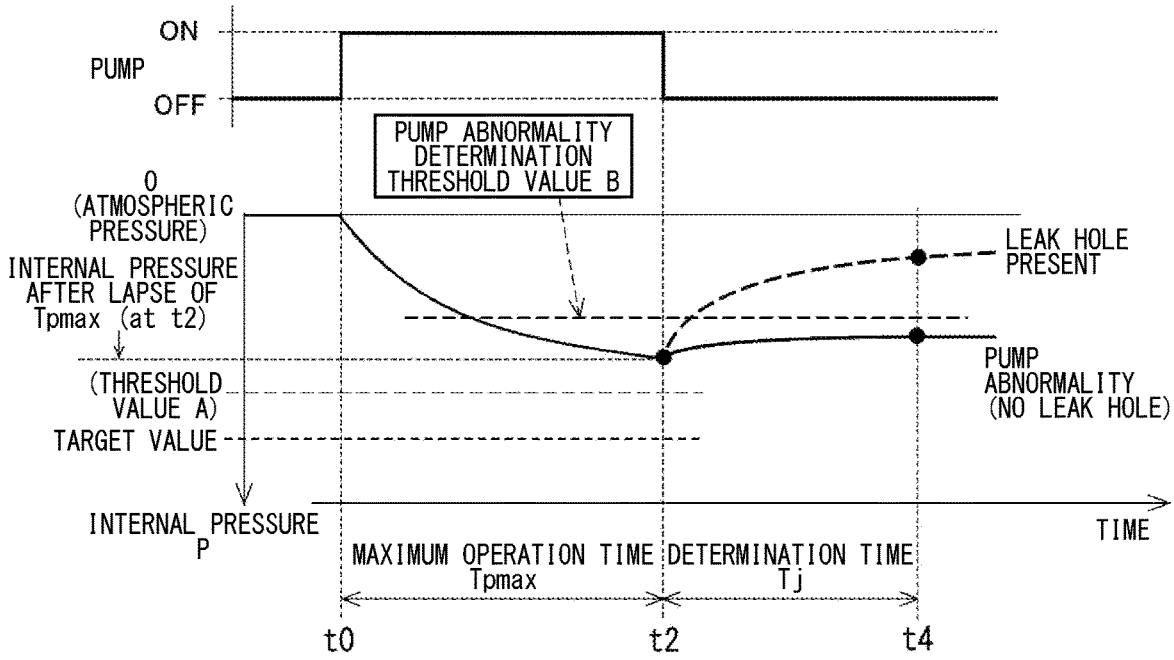

Leak and pump abnormality determination according to the first embodiment is described with reference to FIGS. 2 to 4. The time chart of FIG. 2 shows a relationship between (i) an operation and a stop of the pump 15 and (ii) the time change of the pressure in the system. The abnormality determiner 17 determines whether an absolute value of the system internal pressure (i.e., the in-system pressure) reaches a target value within a maximum operation time Tpmax of the pump 15, and, depending on whether the target value is reached, the abnormality determiner 17 switches (i) a "normal leak determination mode" (when target value is reached) and (ii) a "pump abnormality determination mode" (when target value is not reached). FIG. 2A shows a time change of the normal leak determination mode, and FIG. 2B shows a time change of the pump abnormality determination mode for in the decompression pump. In case of using a pressurizing pump, the vertical axis of FIG. 2B is reversed.

In the normal leak determination mode shown in FIG. 2A, the presence or absence of a leak hole in the evaporation piping system 200 is determined based on an assumption that the pump 15 is normal. When the operation of the pump 15 is started at time to, an absolute value |P| of the internal pressure (i.e., the in-system pressure) gradually increases. When the absolute value |P| of the system internal pressure (i.e., the in-system pressure) reaches the target value at time t1 within the maximum operation time Tpmax from time t0, the abnormality determiner 17 stops the pump 15.

Subsequently, the absolute value |P| of the in-system pressure at time t3 after a determination time Tj has elapsed from time t1 is compared with a normal leak determination threshold value A. Here, the normal leak determination threshold value A is set to be slightly smaller than the target value. When the absolute value |P| of the system internal pressure (i.e., the in-system pressure) at time t3 is greater than the normal leak determination threshold value A, it is determined that no leak hole is present in the system 200, and when the absolute value |P| is equal to or less than the normal leak determination threshold value A, it is determined that a leak hole is present in the system 200.

In the pump abnormality determination mode shown in FIG. 2B, an abnormality of the pump 15 is determined. More specifically, it is distinctively determined whether the pump 15 is abnormal or the evaporation piping system 200 is leaking. When the operation of the pump 15 is started at time t0, the absolute value |P| of the internal pressure (i.e., the in-system pressure) gradually increases, but the target value is not reached even at time t2 when the maximum operation time Tpmax has elapsed from time t0. The abnormality determiner 17 stops the pump 15 at time t2 in such case.

Subsequently, the absolute value |P| of the in-system pressure at time t4 after the determination time Tj has elapsed from time t2 is compared with a pump abnormality determination threshold value B. Here, the pump abnormality determination threshold value B is smaller than the normal leak determination threshold value A, and is set according to the absolute value |P| of the system internal pressure (i.e., the in-system pressure) when the maximum operation time Tpmax elapses, as described later. When the absolute value |P| of the system pressure at time t4 is greater than the pump abnormality determination threshold value B, it is determined that there is no leak hole in the system 200 and the pump is abnormal, and when it is equal to or less than the pump abnormality determination threshold value B, it is determined that there is a leak hole in the system 200.

Figure 3:
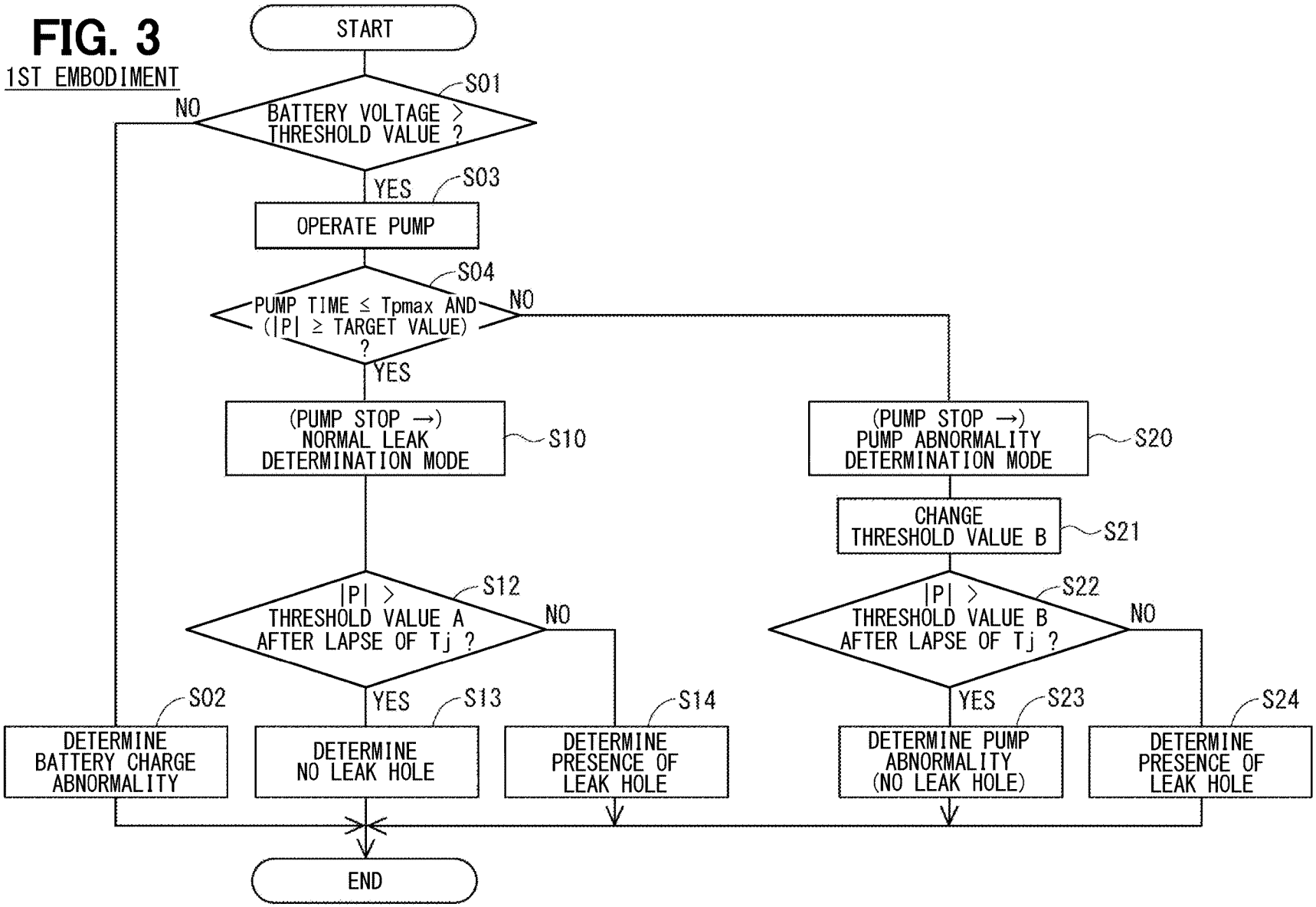
FIG. 3 is a flowchart for a leak determination and a pump abnormality determination according to the first embodiment.

In the flowchart of FIG. 3, the symbol "S" indicates a step. Here, regarding the opening and closing of the block valve 22, when checking the leak hole in a system including the fuel tank 21, the leak determination is performed with the block valve 22 open, and when checking the leak on a canister 23 side of the fuel tank 21, the leak determination is performed with the block valve 22 closed. In the configuration in which no block valve 22 is provided, the leak determination is always performed in the system including the fuel tank 21. In the flowcharts of FIG. 3 and subsequent drawings, the opening/closing step of the block valve 22 is not shown in the flowcharts.

In S01, it is determined whether a battery voltage of the engine is greater than a voltage threshold value, and if NO, it is determined in S02 that the battery charge is abnormal, and the process ends. If YES in S01, the abnormality determiner 17 determines whether or not the absolute value |P| of the system internal pressure (i.e., the in-system pressure) is equal to or higher than a target value in S04 within the maximum operation time Tpmax after starting the operation of the pump 15 in S03. When a pressurizing pump is used, the system internal pressure (i.e., the in-system pressure) P with reference to the atmospheric pressure becomes a positive pressure (P>0), and when a decompression pump is used, the system internal pressure (i.e., the in-system pressure) P with reference to the atmospheric pressure becomes a negative pressure (P<0).

When the absolute value |P| of the system internal pressure (i.e., the in-system pressure) reaches the target value by the operation of the pump 15 and is determined as YES in S04, the abnormality determiner 17 stops the pump 15 in S10 and shifts to the "normal leak determination mode." In the normal leak determination mode, the presence or absence of a leak hole in the evaporation piping system 200 is determined on the premise that the pump 15 is normal.

In S12 of the normal leak determination mode, it is determined whether or not the absolute value |P| of the system internal pressure (i.e., the in-system pressure) after the determination time Tj has elapsed from the stop of the pump 15 is greater than the normal leak determination threshold value A. If YES in S12, the abnormality determiner 17 determines that there is no leak hole in S13, and if NO in S12, determines that there is a leak hole in S14, and the routine ends.

Figure 6:
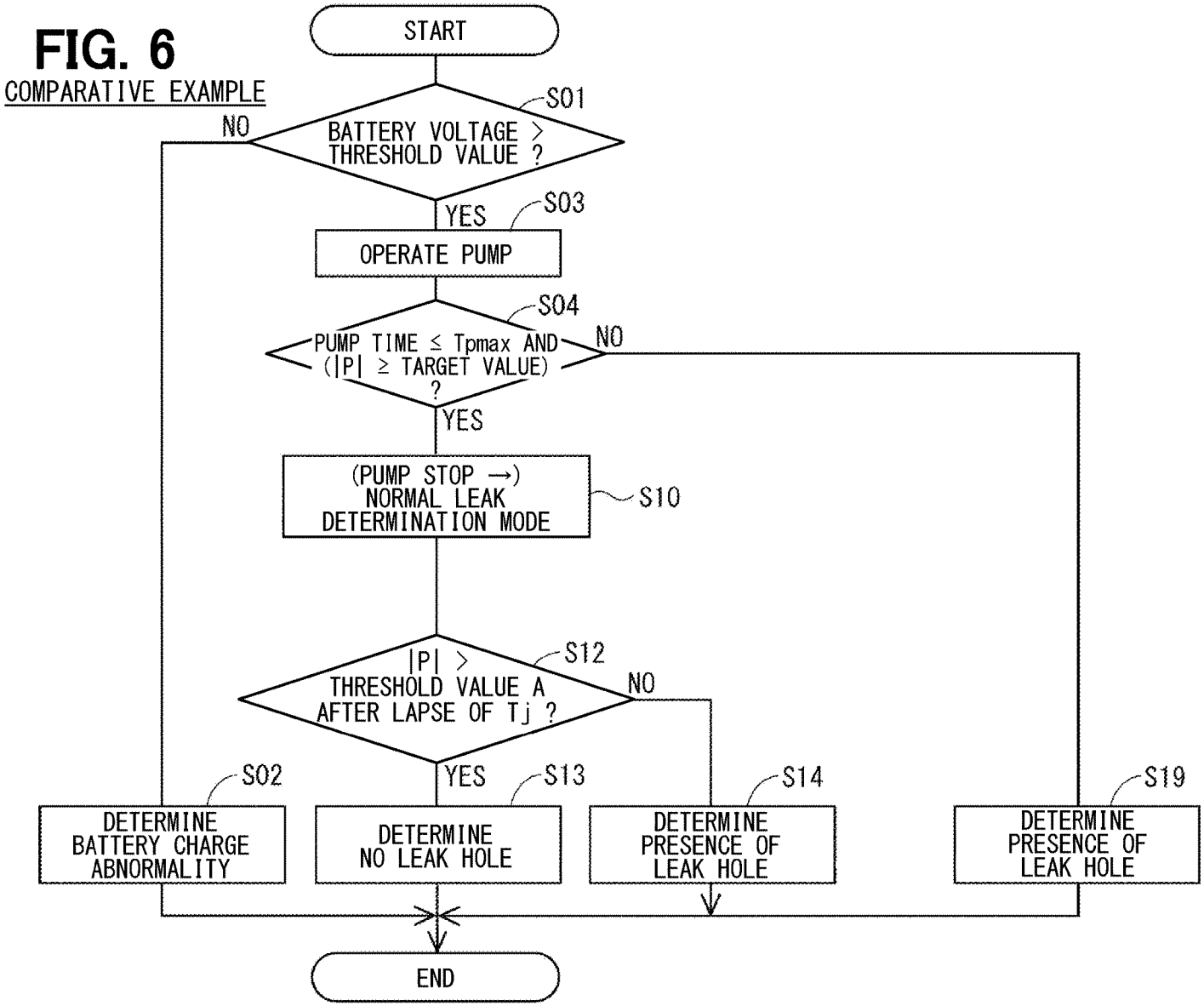
FIG. 6 is a flowchart of the leak determination according to a comparative example.

Next, a following situation is discussed, citing FIG. 6 as a comparative example. That is, a situation where, even after the lapse of the maximum operation time Tpmax from the start of the operation of the pump 15, the absolute value |P| of the system internal pressure (i.e., the in-system pressure) does not reach the target value despite the operation of the pump 15, and it is determined as NO in S04, is compared with the comparative example shown in FIG. 6. S01 to S14 in the leak determination of the comparative example are the same as those in FIG. 3. In the comparative example, when it is determined as NO in S04, it is determined in S19 that there is a leak hole. That is, even in case of an abnormality of the pump 15, it may eventually be determined that there is a leak hole, which is a faulty determination.

Returning to FIG. 3, in the first embodiment, when it is determined as NO in S04, the abnormality determiner 17 stops the pump 15 in S20, and shifts to the "pump abnormality determination mode." In the pump abnormality determination mode, the presence or absence of leak in the evaporation piping system 200 and the abnormality of the pump 15 are determined using the pump abnormality determination threshold value B that is set to a smaller value than the normal leak determination threshold value A of the normal leak determination mode.

In S21, the pump abnormality determination threshold value B is changed according to the absolute value |P| of the system internal pressure (i.e., the in-system pressure) when the maximum operation time Tpmax elapses, that is, when the pump 15 is stopped. Alternatively, instead of the absolute value |P| of the system internal pressure (i.e., the in-system pressure) at the time when the pump 15 is stopped, the pump abnormality determination threshold value B may also be changed according to a correlation value correlated to, for example, the absolute value |P| of the system internal pressure (i.e., the in-system pressure) immediately before or after the pump 15 is stopped.

Figure 4:
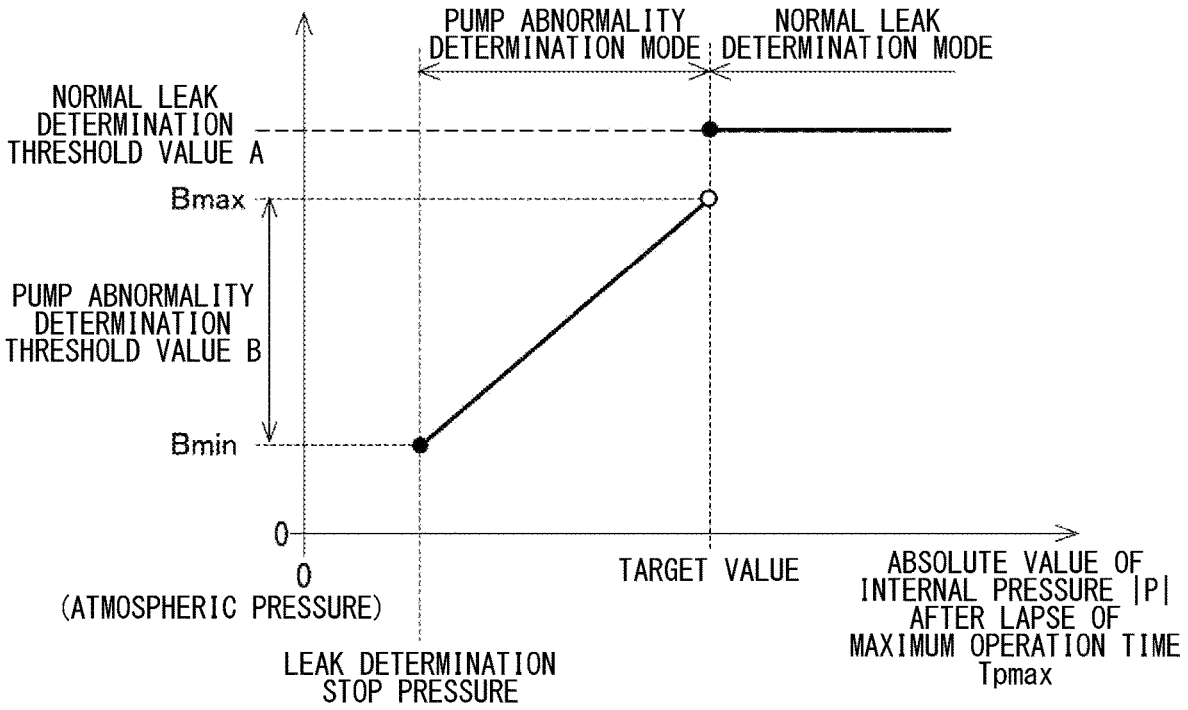
FIG. 4 is a diagram for changing a pump abnormality determination threshold value according to a pressure inside the system.

As shown in FIG. 4, the greater the absolute value |P| of the in-system pressure is when the maximum operation time Tpmax elapses (that is, at time t2 in FIG. 2), the greater the pump abnormality determination threshold value B is set. When the absolute value |P| of the system pressure is equal to or higher than the target value, the normal leak determination threshold value A is used in the normal leak determination mode regardless of S21. When the absolute value |P| of the in-system pressure is less than the target value and very close to the target value, the pump abnormality determination threshold value B is set to a maximum value Bmax slightly smaller than the leak determination threshold value A. When the absolute value |P| of the system internal pressure (i.e., the in-system pressure) is a "leak determination stop pressure" which is close to the atmospheric pressure, the pump abnormality determination threshold value B is set to a minimum value Bmin.

Note that, when the absolute value |P| of the system internal pressure (i.e., the in-system pressure) is smaller than the "leak determination stop pressure," it is considered that a serious leak or a serious pump failure has occurred, so the abnormality determiner 17 stop the leak determination, and, for example, a warning is notified to the vehicle control circuit 18. The illustration of such operation is omitted from FIG. 3.

In S22 of the pump abnormality determination mode, it is determined whether or not the absolute value |P| of the system internal pressure (i.e., the in-system pressure) after the determination time Tj elapses from the stop of the pump 15 is greater than the pump abnormality determination threshold value B. If YES in S22, the abnormality determiner 17 determines the "pump abnormality (no leak hole)" in S23. In other words, since the absolute value |P| of the system internal pressure (i.e., the in-system pressure) is maintained, it is determined that there are no leak holes, and that the pump 15 thus has abnormality which has caused that the absolute value |P| misses the target value even though there are no leak holes. Further, in case of NO in S22, the abnormality determiner 17 determines in S24 at least "there is a leak hole." In addition, S24 includes a case of a compound abnormality of "there is a leak hole and the pump is abnormal." Then, comes the end of the routine.

As described above, in the first embodiment, when the pump 15 does not function sufficiently and the absolute value |P| of the system internal pressure (i.e., the in-system pressure) does not reach the target value, the abnormality determination of the pump 15 and the leak determination of the evaporation piping system 200 are specifically and distinctively determinable, while preventing a faulty leak determination. In addition, reduction of the man-hours for investigation at the time of repair work is achievable.

Further, since the pump abnormality determination threshold value B in the pump abnormality determination mode is set to be smaller than the normal leak determination threshold value A in the normal leak determination mode, the pump abnormality determination can be performed with an appropriate threshold value. Further, since the pump abnormality determination threshold value B is changed according to the absolute value |P| of the system pressure at the time when the pump 15 is stopped or its correlation value, the pump abnormality determination can be performed with a more appropriate threshold value.

Second Embodiment

Figure 5:
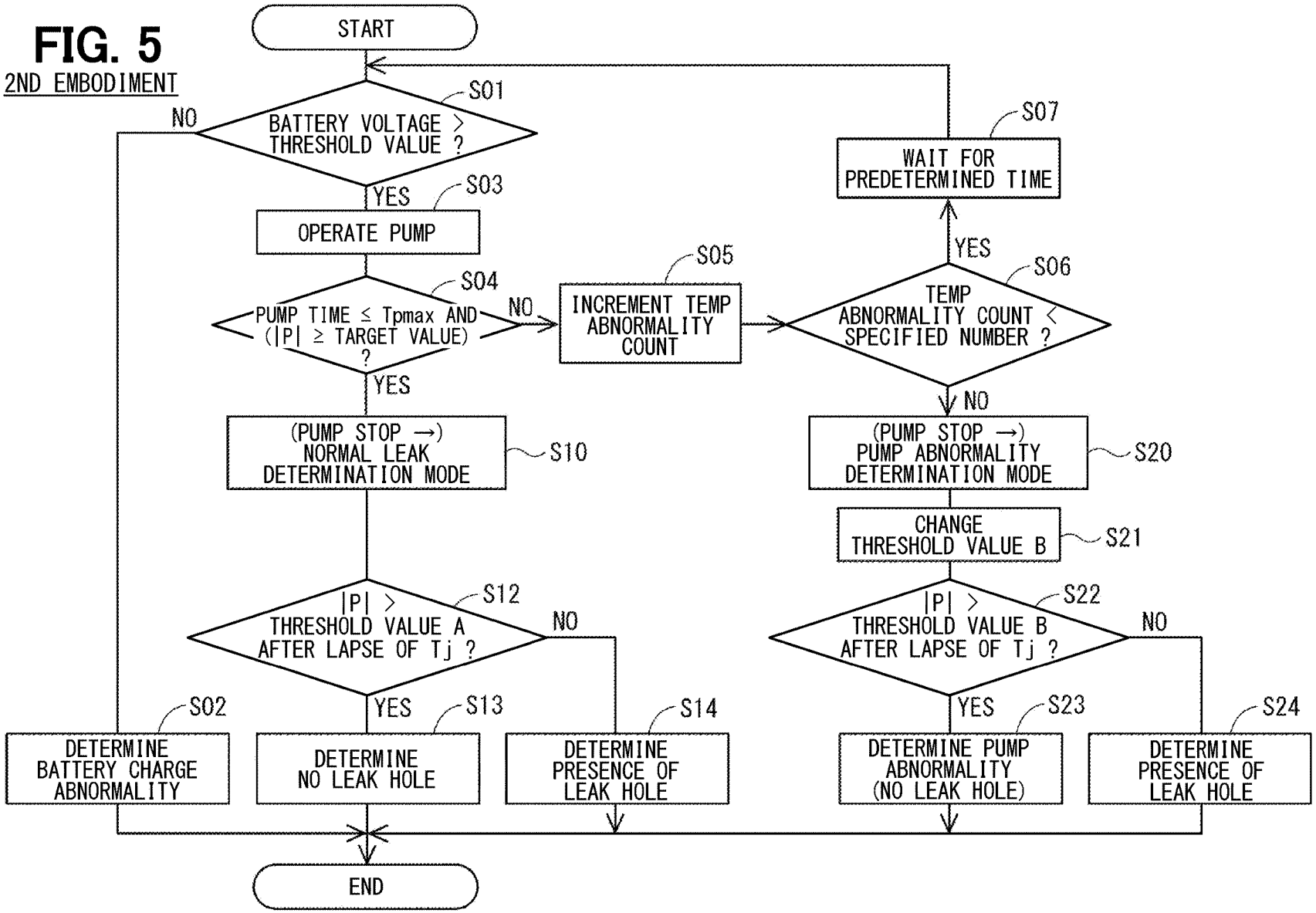
FIG. 5 is a flowchart of the leak determination and the pump abnormality determination according to a second embodiment.

Next, the leak determination and the pump abnormality determination according to the second embodiment is described with reference to the flowchart of FIG. 5. In FIGS. 5, S05 to S07 are added to FIG. 3. The other steps common with FIG. 3 are given the same step numbers as those in FIG. 3, and duplicate description is omitted.

In S04 of FIG. 3 according to the first embodiment, if the absolute value |P| of the system internal pressure (i.e., the in-system pressure) does not reach the target value and is determined as NO, the process immediately shifts to S20. However, due to an irregular event such as the generation of vapor due to a temperature rise or the like, the absolute value |P| of the system internal pressure (i.e., the in-system pressure) may miss (i.e., not reach) the target value even if the pump 15 is normal. Therefore, the second embodiment aims at an object of preventing a faulty determination, by performing the determination of S04 a couple of times with a time interval reserved therebetween until the conditions are stable.

In the second embodiment, if it is determined as NO in S04 of FIG. 5, it is counted as "one temporary abnormality has occurred" in S05. Specifically, the counter for the number of temporary abnormalities is incremented. In S06, it is determined whether or not the number of temporary abnormalities is less than a specified number of times. If YES in S06, the abnormality determiner 17 waits for a predetermined time from the stop of the pump 15 in S07, and then returns to S01. Then, the abnormality determiner 17 restarts the pump 15 in S03, and re-determines whether or not the absolute value |P| of the system internal pressure (i.e., the in-system pressure) has reached the target value in S04.

If it is determined again as NO in S04 and YES in S06, the loop returning to S01 is repeated. If YES is determined in S04 during the loop, the process shifts to the normal leak determination mode in S10. On the other hand, when the number of temporary abnormalities reaches the specified number of times, it is determined as NO in S06, and the process shifts to the pump abnormality determination mode in S20. Thereby, in the second embodiment, it is possible to appropriately prevent faulty determination related to the pump abnormality.

Other Embodiments

The configuration of the evaporative fuel processing device 10 of the present disclosure is not limited to the one illustrated in FIG. 2. For example, as described above, the block valve 22 may be dispensed. Further, the pump 15 and the pressure sensor 16 may be provided at other positions in the evaporation piping system 200.

The present disclosure is not limited to the above-described embodiments, and can be implemented in various forms without departing from the spirit of the present disclosure.

What is claimed is:

1. An evaporative fuel processing device for determining a leak in an evaporation piping system that is defined by a fuel tank connected to a canister absorbing evaporated fuel via a vapor passage, an atmospheric on-off valve provided in an atmospheric passage that connects the canister and an air opening, and a purge valve provided in a purge passage that connects the canister and an intake passage, the evaporative fuel processing device comprising:

a pump, configured to pressurize or depressurize an internal pressure of the evaporation piping system for leak determination, pressurizing the internal pressure to a positive value with respect to an atmospheric pressure or depressurize the internal pressure to a negative value with respect thereto;

a pressure sensor, configured to detect the internal pressure; and an abnormality determination device comprising processor and a computer-readable storage medium storing instructions which upon execution by the processor causes the an abnormality determination device to be configured to determine whether (i) the evaporation piping system has a leak hole or (ii) the pump has an abnormality based on the internal pressure detected by the pressure sensor, wherein the abnormality determination device shifts between modes, the modes including:

(A) a normal leak determination mode for determining a presence or absence of the leak hole in the evaporation piping system when an absolute value of the internal pressure reaches a target value by an operation of the pump based on an assumption that the pump is normal, and in the normal leak determination mode, the abnormality determination device determines that the evaporation piping system has the leak hole when the absolute value of the internal pressure of the system is equal to or less than a normal leak determination threshold value after lapse of a determination time from stop of the operation of the pump, and (B) a pump abnormality determination mode for determining abnormality of the pump when the absolute value of the internal pressure does not reach the target value by an operation of the pump.

2. The evaporative fuel processing device of claim 1, wherein the abnormality determination device in the pump abnormality determination mode compares the absolute value of the internal pressure after lapse of the determination time from stop of the operation of the pump with a pump abnormality determination threshold value that is set to a value smaller than the normal leak determination threshold value in the normal leak determination mode, and determines abnormality of the pump when the absolute value of the internal pressure is greater than the pump abnormality determination threshold value, or determines the evaporation piping system at least has the leak hole when the absolute value of the internal pressure is equal to or less than the pump abnormality determination threshold value.

3. The evaporative fuel processing device of claim 2, wherein the abnormality determination device changes the pump abnormality determination threshold value according to the absolute value of the internal pressure when the pump is stopped or a correlation value thereof in the pump abnormality determination mode.

4. The evaporative fuel processing device of claim 1, wherein the abnormality determination device counts, as a temporary abnormality, an occasion where the absolute value of the internal pressure does not reach the target value when operating the pump, and re-determines whether the absolute value of the internal pressure has reached the target value after restarting the pump when waiting for a predetermined time from the stop of the operation of the pump before restart, and when a temporary abnormality count exceeds a specified number, the abnormality determination device shifts to the pump abnormality determination mode.

5. An abnormality determination device for use in an evaporative piping system, wherein the evaporative piping system includes:

a fuel tank, a pressure sensor configured to measure a pressure, a canister, a vapor passage connecting the fuel tank to the canister, a purge passage leading from the canister to an intake manifold, a purge valve located in the purge passage, an atmospheric passage leading from the canister to an atmospheric opening, a pump located in the atmospheric passage, and an atmospheric valve located in the atmospheric passage, and located between the pump and the atmospheric opening, wherein the abnormality determination device comprises:

(i) a processor; and (ii) a computer-readable storage medium, wherein the abnormality determination device is configured to:

close the purge valve and the atmospheric valve;

operate the pump;

determine whether a first set of conditions is satisfied; and shift between modes, the modes including:

(A) a normal leak determination mode for determining a presence or absence of the leak hole in the evaporation piping system when the first set of conditions is determined to be satisfied, wherein the first set of conditions includes (i) determining that a pumping time is less than a maximum pumping time, and (ii) an absolute value of the internal pressure reaching a target value by an operation of the pump, and in the normal leak determination mode, the abnormality determination device is configured to determine that the evaporation piping system has the leak hole when the absolute value of the internal pressure of the system is equal to or less than a normal leak determination threshold value after lapse of a determination time from stop of the operation of the pump, and (B) a pump abnormality determination mode for determining abnormality of the pump when at least the first set of conditions is determined to not be satisfied such that an absolute value of the internal pressure does not reach the target value by an operation of the pump.

6. The abnormality determination device of claim 5, wherein the abnormality determination includes:

determining an abnormality threshold value based on a measured pressure that is measured when the maximum pumping time lapsed.

7. The abnormality determination device of claim 6, wherein the abnormality threshold value:

is a linear function of the measured pressure, and is less than a normal threshold value.

8. The abnormality determination device of claim 5, wherein the abnormality determination includes:

determining that there is a problem when a measured pressure that is measured when the maximum pumping time lapsed is greater than a leak determination stop pressure.

9. The abnormality determination device of claim 6, wherein the abnormality determination further includes:

determining whether a leaking measured pressure that is measured after a determination time is greater than the abnormality determination threshold value.

10. The abnormality determination device of claim 5, wherein:

the abnormality determination device in the pump abnormality determination mode is configured to compare the absolute value of the internal pressure after lapse of the determination time from stop of the operation of the pump with a pump abnormality determination threshold value that is set to a value smaller than the normal leak determination threshold value in the normal leak determination mode, and determine abnormality of the pump when the absolute value of the internal pressure is greater than the pump abnormality determination threshold value, or determines the evaporation piping system at least has the leak hole when the absolute value of the internal pressure is equal to or less than the pump abnormality determination threshold value.

11. The evaporative fuel processing device of claim 10, wherein the abnormality determination device is further configured to change the pump abnormality determination threshold value according to the absolute value of the internal pressure when the pump is stopped or a correlation value thereof in the pump abnormality determination mode.

12. The evaporative fuel processing device of claim 5, wherein the abnormality determination device is further configured to:

count, as a temporary abnormality, an occasion where the absolute value of the internal pressure does not reach the target value when operating the pump, and re-determine whether the absolute value of the internal pressure has reached the target value after restarting the pump when waiting for a predetermined time from the stop of the operation of the pump before restart, and shift to the pump abnormality determination mode when a temporary abnormality count exceeds a specified number.

* * * * *